US005815191A

United States Patent [19]

Michielsen et al.

[11] Patent Number: 5,815,191

[45] Date of Patent: Sep. 29, 1998

[54] DIRECT THERMAL PRINTING METHOD AND APPARATUS

[75] Inventors: Joseph Michielsen, Edegem; David Tilemans, Lier; Leo Oelbrandt, Kruibeke; Robert Overmeer, Mortsel; Marc De Clerck, Borsbeek, all of Belgium

[73] Assignee: Agfa-Gevaert, Mortsel, Belgium

[21] Appl. No.: 584,450

[22] Filed: Jan. 11, 1996

[30] Foreign Application Priority Data

Jan. 31, 1995 [EP] European Pat. Off. ..... 95200237

[51] Int. Cl.[6] ..... B41J 2/36

[52] U.S. Cl. ..... 347/188; 347/193

[58] Field of Search ..... 367/171; 347/188, 347/193; 346/33 ME; 400/120.09, 120.13, 103; 235/375

[56] References Cited

U.S. PATENT DOCUMENTS

| | | | |
|---|---|---|---|
| 4,843,409 | 6/1989 | Matsuzaki | 347/188 |
| 5,191,356 | 3/1993 | Shibamiya | 347/188 |
| 5,488,223 | 1/1996 | Austin et al. . | |
| 5,564,841 | 10/1996 | Austin et al. . | |

FOREIGN PATENT DOCUMENTS

| | | | |
|---|---|---|---|
| 5-38839 | 2/1993 | Japan | 347/193 |

*Primary Examiner*—Haun H. Tran
*Attorney, Agent, or Firm*—Baker & Botts, L.L.P.

[57] ABSTRACT

A method and apparatus is provided for operating a direct electrostatic printer whereby no printer adjustments are required by the operator. The direct thermal printer includes a print head and a variable speed motor for reproducing images on an imaging element. The method for operating the direct electrostatic printer includes the steps of: receiving medical image data representing the medical images; processing one or more printing prerequisites provided with the medical image data for controlling heating energy applied to the print head and for controlling the speed of the variable speed drive motor; generating a control signal from the printing prerequisites for controlling the speed of the variable speed drive motor; automatically configuring the printer in a plurality of operating modes using the control signal; passing the imaging element adjacent the print head by means of the variable speed drive motor; and heating the print head in accordance with the medical image data and the printing prerequisites to form the medical images on the imaging element. In addition, the printer is capable of operating in at least two modes, including a standard quality operating mode in which the variable speed drive motor is operated at a first speed, and at least one premium quality operating mode in which the variable speed drive motor is operated at a second speed slower than the first speed.

28 Claims, 2 Drawing Sheets

DIRECT THERMAL PRINTING METHOD AND APPARATUS

FIELD OF THE INVENTION

The present invention relates to a method and to a printer for direct thermal imaging.

BACKGROUND OF THE INVENTION

Thermal imaging or thermography is a recording process wherein images are generated by the use of imagewise modulated thermal energy. Thermography is concerned with materials which are not photosensitive, but are sensitive to heat or thermosensitive and wherein imagewise applied heat is sufficient to bring about a visible change in a thermosensitive imaging material, by a chemical or a physical process which changes the optical density.

Most of the direct thermographic recording materials are of the chemical type. On heating to a certain conversion temperature, an irreversible chemical reaction takes place and a coloured image is produced.

In direct thermal printing, said heating of the recording material may be originating from image signals which are converted to electric pulses and then through a driver circuit selectively transferred to a thermal print head. The thermal print head consists of microscopic heat resistor elements, which convert the electrical energy into heat via the Joule effect. The electric pulses thus converted into thermal signals manifest themselves as heat transferred to the surface of the thermal material, e.g. paper, wherein the chemical reaction resulting in colour development takes place. This principle is described in *"Handbook of Imaging Materials"* (edited by Arthur S. Diamond - Diamond Research Corporation - Ventura, Calif., printed by Marcel Dekker, Inc. 270 Madison Avenue, N.Y., ed 1991, p. 498–499).

A particular interesting direct thermal imaging element uses an organic silver salt in combination with a reducing agent. Such combination may be imaged by a suitable heat source such as e.g. a thermal print head, a laser etc. A black and white image can be obtained with such a material because under influence of heat the silver salt is developed to metallic silver.

It may be desirable to modify the conditions under which the printer operates, for example to change from a standard operating mode to a fast operating mode. For example, in the fast operating mode one or more of the following changes may be desirable:

(a) an increase in "throughput" (or number of prints per time unit), (b) an increased "addressability" (or apparent resolution, or number of addressable dots per inch, abbreviated as "dpi").

It is a disadvantage of direct thermal printers known in the art that the quantity (or "throughput") of prints (or printed images) may not be as high as may be desired in certain circumstances and also that most such printers cannot easily be modified to change the operating mode, or if such modifications are possible, they must be made by the operator.

OBJECTS OF THE INVENTION

It is an object of the present invention to provide a direct thermal printing method in which a printing prerequisite of the printed image is at a desired level according to the prevailing circumstances.

It is a further object of the present invention to provide a direct thermal printing method in which, in order to modify the conditions under which an image is printed, the necessary adjustments which need to be made to the printer by the operator are minimised.

It is a still further object of the present invention to provide an apparatus for direct thermal printing an image which modifies the conditions under which an image is printed automatically, with minimal adjustments to be made by the operator.

Further objects and advantages will become apparent from the description given hereinbelow.

SUMMARY OF THE INVENTION

We have now discovered that these objects can be achieved by the provision of automatic change-over means for switching the printer between operating modes.

According to a first aspect of the invention there is provided a method of operating a direct thermal printer comprising:

passing an imaging element (3) adjacent a print head (16), by means of a variable speed drive motor (18);

feeding heating energy to said print head in accordance with image data to form an image in said imaging element;

controlling said heating energy and the speed of said drive motor in accordance with at least one printing prerequisite; and automatically switching said printer between at least two operating modes including a standard operating mode in which said drive motor is driven at a standard speed and a fast operating mode in which said drive motor is driven at a relatively fast speed.

According to the present invention, said imaging element (3) comprises on a support at least one layer comprising in a binder at least one silver compound and at least one reducing agent, said reducing agent being capable of reducing upon heating said silver compound to metallic silver.

According to another aspect of the invention there is also a direct thermal printing method wherein said imaging element (3) is a combination of a donor element (2) comprising on a support at least one donor layer comprising a thermotransferable reducing agent capable of reducing a silver compound to metallic silver upon heating in face to face relationship with a receiving element (1) comprising on a support at least one receiving layer comprising at least one silver compound capable of being reduced by means of heat in the presence of a reducing agent.

Also provided is an apparatus for direct thermal printing an image by using the above mentioned method.

By the wording "prerequisite", in the present application, are ment criteria as e.g. "throughput" (or number of prints or printed images pro time unit) and "quality". By the wording "quality", in the present application, are ment criteria as e.g. "addressability" (cfr. resolution or number of addressable dots pro inch, dpi), "maximal optical density", "tone or colour neutrality" (cfr. black or grey aspect of the prints), "number of perceptable density levels" and "banding" (cfr. across-the-head uneveness in printing density).

The method according to the present invention preferably includes automatically switching between operating modes in response to predetermined prerequisite signals. The prerequisite signals may be included in the data fed to the printer in a number of ways, for example (i) within the image data (i.e. part of the "bit-map" and read, for example by optical character recognition or (ii) aside from the image data in a so-called "header". Examples of such data may included the type of medical apparatus involved, the name of the operator or specialist, the name of the patient and the patient's medical history.

Thermal imaging can be used for production of both transparencies and reflection-type prints. In the hard copy field, recording materials based on an opaque, usually white, base are used, whereas in the medical diagnostic field monochrome, usually black, images on a transparent base find wide application, since such prints can conveniently be viewed by means of a light box.

Thus, in a preferred embodiment of the present invention, the printer may further comprise a sensor for generating a signal indicative of the type of the imaging element material, wherein the automatic change-over means operates in response to the imaging element material type signals. The method according to this embodiment of the invention thus preferably further comprises automatically switching between the operating modes in response to the imaging element material type signals. For example, this sensor may be capable of distinguishing between an imaging element being opaque and an imaging element being transparent. A suitable sensor for this purpose is a high efficiency light emitting diode.

In a still further alternative embodiment, the printer may further comprise a sensor for generating a signal indicative of the quality of the printed image, wherein the automatic change-over means operates in response to the printed image quality signals. A suitable sensor for this purpose may be an opto-electronic sensor with a high dynamic range. The method according to this embodiment of the invention thus preferably further comprises automatically switching between the operating modes in response to the printed image quality signals. The calibration of this control may involve the making and examination of a test print.

The image data may be in the form of medical image picture data received from a medical imaging device, especially a scanning medical image camera. The image data may include additional data alpha/numeric data. Such additional data alpha/numeric data may, for example, be related to the subject of the medical image picture. Alternatively or additionally, such additional data alpha/numeric data may, for example, be indicative of technical information related to conditions under which the medical image picture was taken. For example, ultrasound doppler technology provides colour images for which a lower density print may be more appropriate, whereas in computer thermographic imaging and in magnetic resonance imaging generally black and white images of high density are preferred. The additional alpha/numeric data included in the image data, may relate to these requirements. The method according to the invention preferably includes automatically switching between the operating modes in response to predetermined signals included in this additional data.

BRIEF DESCRIPTION OF THE DRAWINGS

The invention will now be further described, purely by way of example, by reference to the accompanying drawings in which.

DETAILED DESCRIPTION OF PREFERRED EMBODIMENTS OF THE INVENTION

Figure 1:
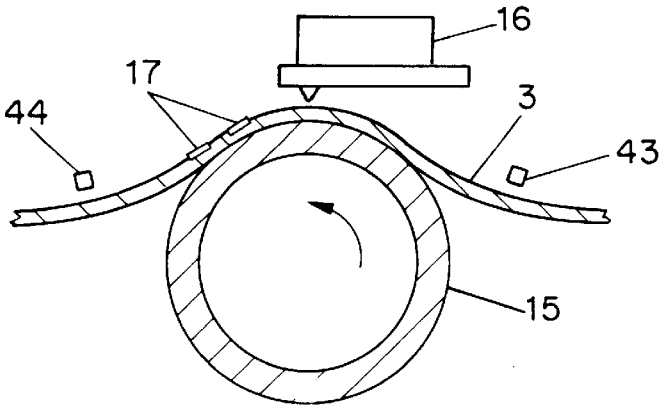
FIG. 1 schematically shows the basic functions of a direct thermal printer.

Referring to FIG. 1, there is shown a global principle scheme of a thermal printing apparatus that can be used in accordance with the present invention. This apparatus is capable to print a line of pixels at a time on a recording material, further called "direct thermal imaging element" 3 or (shortly) "imaging element" 3, comprising on a support a thermosensitive layer comprising an organic silver salt, which generally is in the form of a sheet. The imaging element 3 is secured to a rotatable drum 15, driven by a drive mechanism (not shown) which continuously advances the drum 15 and the imaging element 3 past a stationary thermal print head 16. This head 16 presses the imaging element 3 against the drum 15 and receives the output of the driver circuits. The thermal print head 16 normally includes a plurality of heating elements equal in number to the number of pixels in the image data present in a line memory. The imagewise heating of the heating element is performed on a line by line basis, the "line" may be horizontal or vertical depending on the configuration of the printer, with the heating resistors geometrically juxtaposed each along another and with gradual construction of the output density. Each of these resistors is capable of being energised by heating pulses, the energy of which is controlled in accordance with the required density of the corresponding picture element. As the image input data have a higher value, the output energy increases and so the optical density of the hardcopy image 17 on the imaging element 3. On the contrary, lower density image data cause the heating energy to be decreased, giving a lighter picture 17. A sensor 43, positioned adjacent the path of the imaging element, upstream of the print head 16, generates a signal indicative of the type of the recording material 11, e.g. being opaque or being transparant. A further sensor 44, positioned adjacent the path of the imaging element, downstream of the print head 16, generates a signal indicative of the quality of the printed image.

The printer is capable of operating in at least two modes, including a standard operating mode in which the drive motor 18 is driven at a standard speed and a fast operating mode in which the drive motor 18 is driven at a relatively fast speed.

Figure 2:
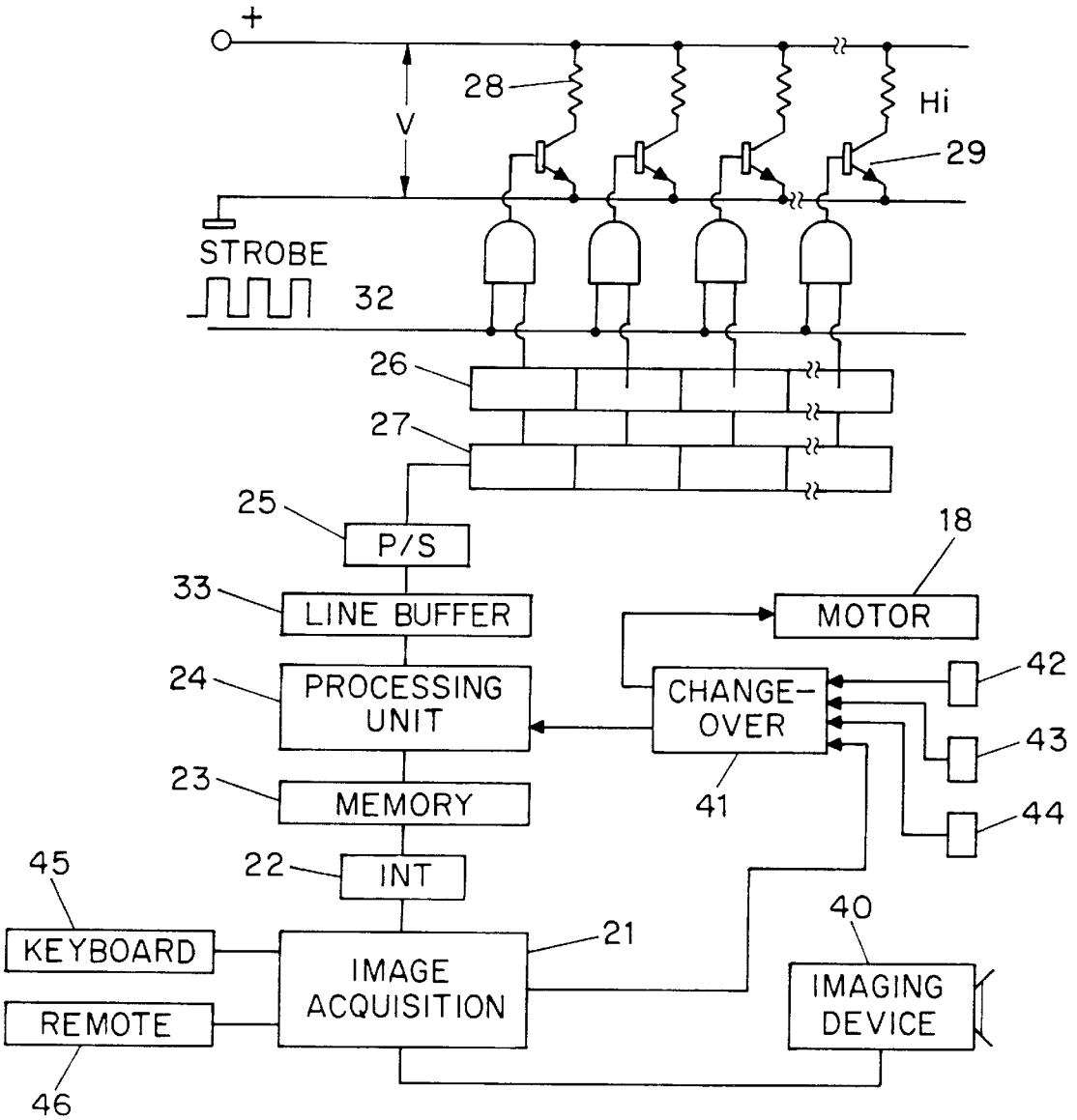
FIG. 2 an electronic circuit according to the present invention for use with the printer illustrated in FIG. 1.

Referring to FIG. 2, the different processing steps up to the activation of the heating elements are illustrated. First a digital signal representation is obtained from an imaging device 40 in an "image acquisition apparatus" 21 (also described as "control means 21 for receiving image data"), for example from (see referral 40) an X-ray camera or from a graphic system. The image data includes not only picture data, but also additional alpha/numeric data related to the subject of the (e.g. X-ray) picture and indicative of technical information related to conditions under which the (e.g. X-ray) picture was taken, this additional data being supplied from a keyboard 45 or a remote control device 46. The image acquisition apparatus 21 serves to separate out picture data from the alpha/numeric data contained in the image data, such as by optical character recognition (often indicated by "OCR") of the alpha/numeric data.

Then, the picture data signal is applied via a digital interface 22 and a first storage means (MEMORY) 23 to a data processor 24, which assigns a pulse width and number and the heating energy applied to a given heating element 28. After processing, the digital image signals are fed via a line buffer 33 to a parallel to serial converter 25 of which an advantageous embodiment is disclosed in European Patent Application EPA 91.201.608.6 (in the name of Agfa-Gevaert) to produce a stream of serial data of bits representing the next line of data to be printed which is passed to a second storage means in the form of a shift register 26. Thereafter, under controlled conditions, these data bits are supplied in parallel to the associated inputs of a latch register 27. Once the bits of data from the shift register 26 are stored in the latch register 27, another line of bits can be subsequently clocked into the shift register 26.

The upper terminals 30 of the heating elements 28 are connected to a positive voltage source V, while the lower terminals 31 of the heating elements are respectively connected to the collectors of drive transistors 29, whose emitters are grounded. These transistors 29 are selectively turned on by a high state signal, indicated as an ANDed STROBE signal supplied on line 32 applied to the bases of the transistors 29 to allow energy to flow through the associated heating elements 28. In this way a direct thermal hardcopy 17 of the electrical image data is recorded.

Automatic change-over means 41, mainly comprising a dedicated software program in addition to the above mentioned sensors and user preferences, are provided for switching the printer between the operating modes.

The change-over means 41 receives signals from the imaging element material sensor 43 and from the output sensor 44. The change-over means 41 also receives alpha/numeric data separated from the image signal by the image acquisition apparatus 21. The change-over means 41 operates in response to signals included in the image data, to signals from sensor 43 and signals from sensor 44, to adjust the speed of the variable speed motor 18 and to change the criteria applied by the processing unit 24, in particular to change one or more of pulse width, pulse number and heating energy.

The heating energy and the speed of the drive motor 18 are thereby controlled in accordance with print prerequisites.

Figure 3:
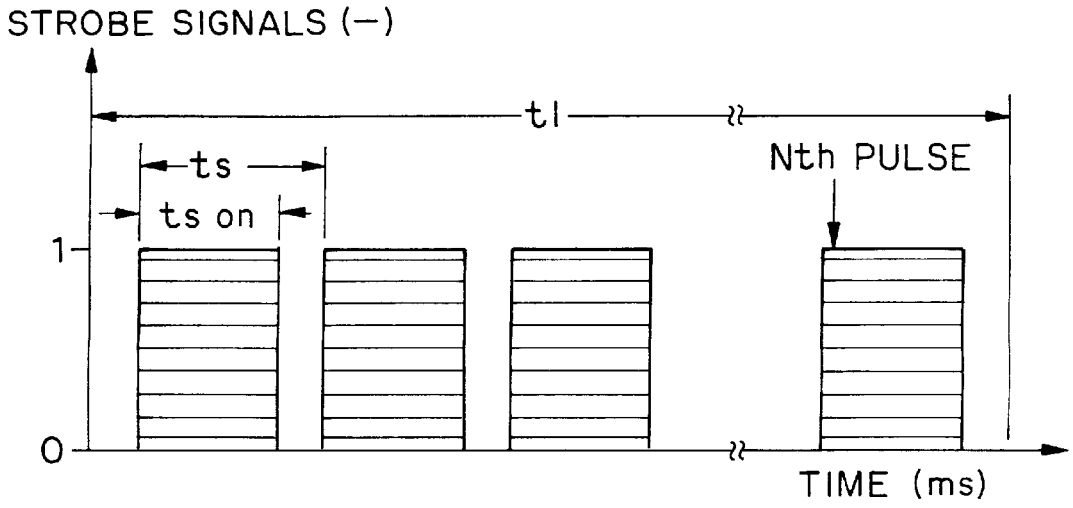
FIG. 3 shows the activation pulses according to the present invention applied to a heating element of the circuit in FIG. 2.

In a preferred embodiment according to European Patent Application 92203816.1 (Agfa-Gevaert NV) the activation of the heating elements in executed pulse-wise in a manner referred to as "duty cycled pulsing", which is illustrated in the accompanying FIG. 3, showing the current pulses applied to a single heating element (reference 28 in FIG. 2).

The repetition strobe period ($t_s$) consists of one heating cycle ($t_{son}$) and one cooling cycle ($t_s$–$t_{son}$) as indicated in FIG. 3. The strobe pulse width ($t_{son}$) is the time during which an enable strobe signal is on. The strobe duty cycle of a heating element is the ratio of the pulse width ($t_{son}$) to the repetition strobe period ($t_s$).

Supposing that the maximum number of obtainable density values attains N levels, the line time ($t_1$) is divided by the number (N) of strobe pulses each with a repetition strobe period $t_s$ as indicated in FIG. 3. In the case of for example 1024 density values, according to a 10 bits format of the corresponding electrical image signal values, the maximum diffusion time would be reached after 1024 sequential strobe periods.

In a further preferred embodiment of the present invention, a "third operating mode" may be introduced. In this third mode, the line time of the printing system is changed in accordance with a printing prerequisite. More specifically, if an increased addressability (or resolution) is prescribed, certain criteria applied by the processing unit 24 are changed, in particular so that the line time is decreased.

Various modifications of the present description will become possible for those skilled in the art after receiving the teaching of the present application without departing from the scope thereof.

The print head used in the printer according to the invention may take a number of different forms.

Thus, the print head may comprise a thermal print head for image-wise heating the thermosensitive layer, comprising individually energisable juxtaposed heating elements. Thermal print heads that can be used are commercially available and include the Fujitsu Head FTP-040 MCS001, the TDK Thermal Head F415 HH7-1089 and the Rohm Thermal Head KE 2008-F3.

Although line-type print heads having a one dimensional array have been referred to here, the present invention can also make use of two dimensionally arranged print head arrays.

Up to now, "direct thermal printing" mainly was directed towards a method of representing an image of the human body obtained during medical imaging and most particularly to a printer intended for printing medical image picture data received from a medical imaging device. More in particular, said image data may be medical image picture data received from a medical image camera 40.

However, in another preferred embodiment of the present invention, the image data may be graphical image picture data received from a computerized publishing system.

For example, image data may be in the form of screens representing graphical images for use in printing art. These screens can be obtained by computer Desk-Top Publishing systems, such as e.g. Ventura publisher (tradename). These systems combinate both text and pictures, retrieved from e.g. manual input in Word processors (e.g. Wordperfect; tradename), OCR, picture scanners and software used for image manipulation (e.g. Adobe Photoshop; tradename).

They output alphanumeric data in different file formats, that can be defined by the user, such as e.g. Postscript. These output files can be transformed to a format that can be "understood" by the thermal printer. If necessary, additional data can be attached to the file to control the settings of the printer.

Hereabove, "direct thermal printing" mainly comprises so-called monosheet imaging elements (indicated by referral 3 in FIG. 1).

Figure 4:
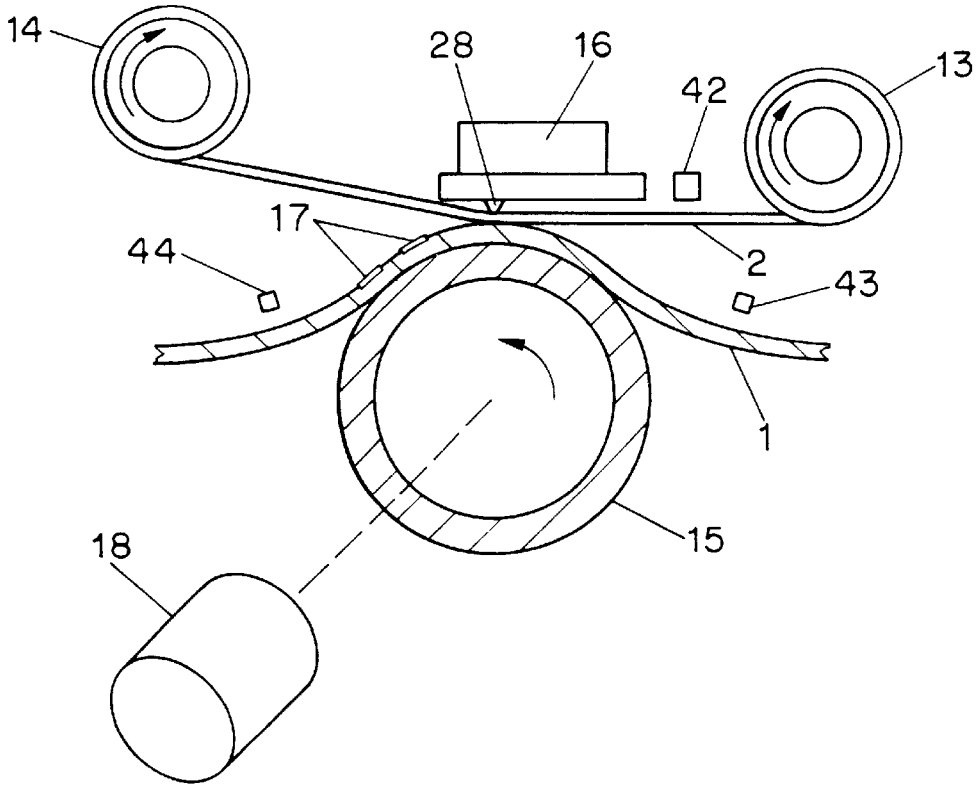
FIG. 4 schematically shows the basic functions of a direct thermal printer which uses a protective or a reductor-donor ribbon.

However, "direct thermal printing" also comprises a so-called "donor ribbon or donor element" -which may be "a protective ribbon" or which may be "a reduction ribbon"- (indicated by referral 2 in FIG. 4) and a so-called "receiving element" (indicated by referral 1 in FIG. 4).

Direct thermal monosheet imaging elements are described in e.g. EPA-94.201.717.9 and EPA-94.201.954.8 (both in the name of Agfa-Gevaert) and in WO 94/16361 (in the name of Labelon Corp. U.S.A.). Direct thermal printing with a so called protective ribbon is described e.g. in EPA-92.204.008.4 (in the name of Agfa-Gevaert). Direct thermal printing with a so called reduction ribbon is described e.g. in EPA-92.200.612.3 (in the name of Agfa-Gevaert).

It is of great advantage to know that the method of the present invention is applicable in each of these printing techniques. Because said printing techniques are already described in the just mentioned EPA applications, here a small summary may be sufficient. Reference may be made to FIG. 4 which schematically shows the basic functions of a direct thermal printer which uses a reductor (donor) ribbon. As many elements of FIG. 4 are similar in structure and in operation to the correspondingly numbered structural elements described in relation to FIG. 1, a full description of FIG. 4 is not necessary here (in order to avoid duplication of explanation).

Reduction ribbon printing uses a thermal print head 16, which can be a thick or a thin film thermal print head, to selectively heat specific portions of the donor element 2 in contact with a receiving element 1. Supply roller 13 and take-up roller 14 are driven by variable speed motor 18 with a predetermined tension in the web or ribbon of the donor element 2.

A donor sensor 42 positioned adjacent the donor material path generates a signal indicative of the presence of a donor element 2. The sensor 42 is capable of distinguishing between a direct thermal printing system with a monosheet imaging element (as illustrated in FIG. 1) and a direct thermal printing system with both a donor element and a receiving element (as illustrated in FIG. 4).

In reductor ribbon printing, the change-over means 41 receives signals from the donor sensor 42, from the receiving element sensor 43 and from the output sensor 44, indicative respectively of the nature of the donor 2, of the nature of the receiving element 1 and of the quality of the printed image respectively. The change-over means 41 also receives alpha/numeric data separated from the image signal by the image acquisition apparatus 21. The change-over means 41 operates in response to predetermined quality signals included in the image data, the donor signal from the sensor 42, the receiving element material type from the sensor 43 and the printed image quality signals from the sensor 44, to adjust the speed of the variable speed motor 18 and to change the criteria applied by the processing unit 24, in particular to change one or more of pulse width, pulse number and heating energy. The heating energy and the speed of the drive motor 18 are thereby controlled in accordance with the predetermined print quality.

Thus, in a further embodiment of the present invention, there is also provided a direct thermal printing method wherein said imaging element 3 is a combination of a donor element 2 comprising on a support at least one donor layer comprising a thermotransferable reducing agent capable of reducing a silver compound (e.g. silver behenate) to metallic silver upon heating in face to face relationship with a receiving element 1 comprising on a support at least one receiving layer comprising at least one silver compound capable of being reduced by means of heat in the presence of a reducing agent.

According to a still further embodiment of the present invention, a direct thermal printer comprises a print head 16; control means 21 for receiving image data; drive means for passing a donor element 2 comprising on a support a donor layer comprising a binder and a thermotransferable reducing agent capable of reducing a silver source (e.g. silver behenate) to metallic silver upon heating and a receiving element 1 comprising on a support a receiving layer comprising a silver source capable of being reduced by means of heat in the presence of a reducing agent, into face to face relationship adjacent said print head 16, said drive means including a variable speed drive motor 18; and heating energy feed means 24, 33, 25 for feeding heating energy to said print head 16 in response to said image data to form an image in said (direct thermal) imaging element 3, said heating energy and the speed of said drive motor 18 being controlled in accordance with a predetermined print quality, wherein said printer is capable of operating in at least two modes, including a standard operating mode in which said drive motor 18 is driven at a standard speed and at least one fast operating mode in which said drive motor 18 is driven at a relatively fast speed, characterised by automatic change-over means 41 for switching said printer between said operating modes. Preferably, said thermally reducible source of silver is an organic silver salt. More preferably, said organic silver salt is silver behenate.

The present invention is equally applicable to thermal wax printing.

We claim:

1. A method of operating a direct thermal printer for printing medical images on an imaging element, said direct thermal printer having a print head and a variable speed motor, said method comprising the steps of:

receiving medical image data representing said medical images;

processing one or more printing prerequisites provided within said medical image data for controlling heating energy applied to said print head and for controlling the speed of said variable speed drive motor;

generating a control signal using said printing prerequisites for controlling the speed of said variable speed drive motor;

automatically configuring said printer in a plurality of operating modes using said control signal, said printer being capable of operating in at least two modes, including a standard quality operating mode in which said variable speed drive motor is operated at a first speed, and at least one premium quality operating mode in which said variable speed drive motor is operated at a second speed slower than said first speed;

passing said imaging element adjacent said print head by means of said variable speed drive motor; and heating said print head in accordance with said medical image data and said printing prerequisites to form said medical images on said imaging element.

2. The method according to claim 1, wherein said processing step comprises the step of processing printing prerequisites provided within an image header corresponding to said medical image data.

3. The method according to claim 1, wherein:

said imaging element includes at least one layer having at least one silver compound and at least one reducing agent; and said heating step comprises the step of heating said reducing agent such that said silver compound is reduced to metallic silver.

4. The method according to claim 1, wherein:

said imaging element includes a donor element having at least one donor layer including a thermo-transferable reducing agent, and a receiving element including at least one receiving layer having at least one silver compound; and said method further comprises the steps of:

placing said donor element adjacent said receiving element, and heating said reducing agent such that said silver compound is reduced to metallic silver.

5. The method according to claim 1, further comprising the step of providing a signal indicating the type of said imaging element, said imaging element type signal being used, at least in part, to determine said control signal.

6. The method according to claim 1, further comprising the step of providing a signal indicating at least one of said printing prerequisites, said printing prerequisite signal being used, at least in part, to determine said control signal.

7. The method according to claim 1, further comprising the step of providing a signal indicating the quality of said printed medical images, said image quality signal being used, at least in part, to determine said control signal.

8. The method according to claim 7, further comprising the step of calibrating said control signal, said calibrating step comprising the steps of:

generating a test print; and analyzing said test print.

9. The method according to claim 1, wherein said step of combining said medical image data with one or more corresponding printing prerequisites comprises the step of providing image throughput data corresponding to said medical image data.

10. The method according to claim 1, wherein said step of combining said medical image data with one or more corresponding printing prerequisites comprises the step of providing image quality data corresponding to said medical image data.

11. The method according to claim 1, further comprising the step of providing additional image data describing said medical images.

12. The method according to claim 1, wherein said additional image data is alpha-numeric data.

13. The method according to claim 1, wherein said medical image data is received from a medical imaging device.

14. The method according to claim 1, wherein said medical image data is graphical image data received from a computerized publishing system.

15. A direct thermal printer for printing medical images on an imaging element, said direct thermal printer comprising:

a print head;

a variable speed motor;

means for receiving medical image data representing said medical images;

means for processing one or more printing prerequisites provided within said medical image data for controlling heating energy applied to said print head and for controlling the speed of said variable speed drive motor;

means for generating a control signal from said printing prerequisites for controlling the speed of said variable speed drive motor;

automatic change-over means for configuring said printer in a plurality of operating modes using said control signal, said printer being capable of operating in at least two modes, including a standard quality operating mode in which said variable speed drive motor is operated at a first speed, and at least one premium quality operating mode in which said variable speed drive motor is operated at a second speed slower than said first speed;

drive means passing said imaging element adjacent said print head by means of said variable speed drive motor; and heating energy feed means for providing heating energy to said print head in accordance with said medical image data and said printing prerequisites to form said medical images on said imaging element.

16. The printer according to claim 15, wherein said printing prerequisites provided within an image header corresponding to said medical image data.

17. The printer according to claim 15, wherein said imaging element comprises at least one layer comprising at least one silver compound and at least one reducing agent, said silver compound being reduced to metallic silver by heating of said reducing agent.

18. The printer according to claim 15, wherein said imaging element comprises:

a donor element having at least one donor layer comprising a thermo-transferable reducing agent; and a receiving element adjacent said donor element, said receiving element comprising at least one receiving layer comprising at least one silver compound, said silver compound being reduced to metallic silver by heating of said reducing agent.

19. The printer according to claim 15, wherein said control signal is determined, at least in part, by a signal indicating the type of said imaging element.

20. The printer according to claim 15, wherein said control signal is determined, at least in part, by a signal indicating at least one of said printing prerequisites.

21. The printer according to claim 15, wherein said control signal is determined, at least in part, by a signal indicating the quality of said printed medical images.

22. The printer according to claim 21, wherein said control signal is calibrated by generating and analyzing a test print.

23. The printer according to claim 15, wherein said printing prerequisites comprise image throughput data.

24. The printer according to claim 15, wherein printing prerequisites comprise image quality data.

25. The printer according to claim 15, further comprising additional image data describing said medical images.

26. The printer according to claim 25, wherein said additional image data is alpha-numeric data.

27. The printer according to claim 15, wherein said medical image data is received from a medical imaging device.

28. The printer according to claim 15, wherein said medical image data is graphical image data received from a computerized publishing system.

* * * * *

UNITED STATES PATENT AND TRADEMARK OFFICE

CERTIFICATE OF CORRECTION

ıTENT NO. : 5,815,191

ıTED : September 29, 1998

VENTOR(S) : Michielsen et al.

It is certified that error appears in the above-identified patent and that said Letters tent is hereby corrected as shown below:

lumn 9, line 19, "claim 1," should read --claim 11,--.

Signed and Sealed this

Eighth Day of February, 2000

*Attest:*

Q. TODD DICKINSON

*Attesting Officer*

*Commissioner of Patents and Trademarks*